US006176109B1

(12) United States Patent
Tsui

(10) Patent No.: US 6,176,109 B1
(45) Date of Patent: Jan. 23, 2001

(54) COMBINATION LOCK

(75) Inventor: Paul Tsui, Fanling (HK)

(73) Assignee: Kwong Wah Lock Manufactory Ltd., Fanling (HK)

( * ) Notice: Under 35 U.S.C. 154(b), the term of this patent shall be extended for 0 days.

(21) Appl. No.: 09/407,074

(22) Filed: Sep. 28, 1999

(51) Int. Cl.[7] ..... E05B 37/06
(52) U.S. Cl. ..... 70/25; 70/312
(58) Field of Search ..... 70/22, 24–27, 70/312, 318, 333 R

(56) References Cited

U.S. PATENT DOCUMENTS

| | | | | |
|---|---|---|---|---|
| 1,580,573 | * | 4/1926 | Schara | 70/25 |
| 3,386,271 | * | 6/1968 | Morin | 70/25 |
| 3,410,121 | * | 11/1968 | Morin | 70/25 |
| 3,720,082 | * | 3/1973 | Feinberg et al. | 70/25 |
| 4,444,029 | * | 4/1984 | Remington | 70/25 |
| 4,733,548 | * | 3/1988 | Ling | 70/25 |
| 5,125,248 | * | 6/1992 | Ling | 70/25 |
| 5,520,032 | * | 5/1996 | Ling | 70/25 |
| 5,715,709 | | 2/1998 | Lai | 70/25 |
| 5,953,940 | * | 9/1999 | Ling | 70/25 |
| 6,029,481 | * | 2/2000 | Lai | 70/25 |

FOREIGN PATENT DOCUMENTS

| | | | | |
|---|---|---|---|---|
| 605018 | * | 7/1948 | (GB) | 70/25 |
| 636356 | * | 12/1978 | (SU) | 70/25 |
| 9111580 | * | 8/1991 | (WO) | 70/25 |

* cited by examiner

*Primary Examiner*—Suzanne Dino Barrett
(74) *Attorney, Agent, or Firm*—Rabin & Champagne, P.C.

(57) ABSTRACT

A combination lock (100) comprising a body (10) formed with a plurality of parallel slots (20) and a bore (30) intersecting with the slots (20) to form co-axial apertures (32) through the parts of the body (10) immediately above and below each of the slots (20), each said aperture (32) above a respective slot (20) being formed with an unlocking groove (34). A plurality of dials (40) are received in the slots (20) respectively, each of which is formed around its inner side with a ring of equi-angular recesses (42). An inverted J-shaped shackle (60) having a longer limb (62) extends into the bore (30) and passes through the dials (40). The padlock (100) further includes a plurality of tumbler sleeves (50) supported co-axially on the shackle limb (62) for individual rotation, each said sleeve (50) having on its outer side a locking fin (52) engageable with one of the recesses (42) of the respective dial (40) for rotation by the dial (40) to reach an unlocking position aligned with the unlocking groove (34) of the aperture (32) above it such that the sleeve (50) is movable into the aperture (32) for unlocking the shackle (60). The locking fin (52) of at least one of the sleeves (50) has an uppermost end (56) which is formed with a step (54), and the aperture (32) above it includes a false-feel groove (36) apart from the unlocking groove (34) for limited entrance by the uppermost end (56) of the fin (52) at a false-unlocking position, thereby giving a false impression that the respective sleeve (50) has been rotated to the unlocking position.

9 Claims, 3 Drawing Sheets

COMBINATION LOCK

The present invention relates to a combination lock that is capable of providing a false feel against lock picking.

BACKGROUND OF THE INVENTION

Combination locks have been known for a long time, which are useful to prevent access to locked premises or removal of locked items by a person who does not know the preset combination code. A typical combination padlock has several (usually three to four) dials marked with numerals (usually "0" to "9") and includes respective tumbler sleeves rotatable by the dials to unlocking positions according to the combination code for releasing the shackle.

For better protection against lock picking, certain combination padlocks have been designed to have a false feel feature, for example as disclosed in U.S. Pat. No. 5,715,709. Such a feature allows the shackle to move, or to have a tendency to move, slightly outwards when the dials are turned to certain positions other than the unlocking positions, thereby providing a false impression that those dials have been turned to the right, unlocking positions. The construction of this padlock requires the cutting of inclined recess slots (to permit the aforesaid slight shackle movement) at awkward positions difficult to gain access to, which is therefore difficult and thus expensive to manufacture.

The invention seeks to mitigate or at least alleviate such a problem by providing an improved combination lock of this type.

SUMMARY OF THE INVENTION

According to the invention, there is provided a combination lock comprising a body formed with a plurality of parallel slots and a bore intersecting with the slots to form co-axial apertures through the parts of the body immediately above and below each of the slots, each said aperture above a respective slot being formed with an unlocking groove, a plurality of dials received in the slots respectively, each of which is formed around its inner side with a ring of equi-angular recesses, an inverted J-shaped shackle having a longer limb extending into the bore and passing through the dials, and a plurality of tumbler sleeves supported co-axially on the shackle limb for individual rotation, each said sleeve having on its outer side a locking fin engageable with one of the recesses of the respective dial for rotation by the dial to reach an unlocking position aligned with the unlocking groove of the aperture above it such that the sleeve is movable into the aperture for unlocking the shackle, wherein the locking fin of at least one of the sleeves has an uppermost end which is formed with a step, and the aperture above it includes a false-feel groove apart from the unlocking groove for limited entrance by the uppermost end of the fin at a false-unlocking position, thereby giving a false impression that the respective sleeve has been rotated to the unlocking position.

It is preferred that the false-feel groove has a depth which is substantially half of that of the unlocking groove.

Preferably, the step has a depth of substantially 0.1 mm to 0.3 mm.

It is preferred that the locking fin of each of the sleeves has an uppermost end which is formed with a said step, and the respective aperture above it includes a said false-feel groove for co-operation with the uppermost end of the fin in the same manner.

It is further preferred that the unlocking and false-feel grooves extend over the entire length of the apertures in which they are formed, and are aligned with each other as between adjacent apertures.

In a preferred embodiment, said at least one sleeve has a number of stable angular positions corresponding to the number of the recesses in the respective dial, which include the false-unlocking position.

More preferably, the false-feel groove is positioned apart from the unlocking groove at an angle which is any integral multiple of 360° divided by the number of the stable angular positions for said at least one sleeve.

In a specific construction, the false-feel groove is positioned apart from either side of the unlocking groove at an angle of 72°.

The aforesaid combination lock may be in the form of a padlock.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1A:
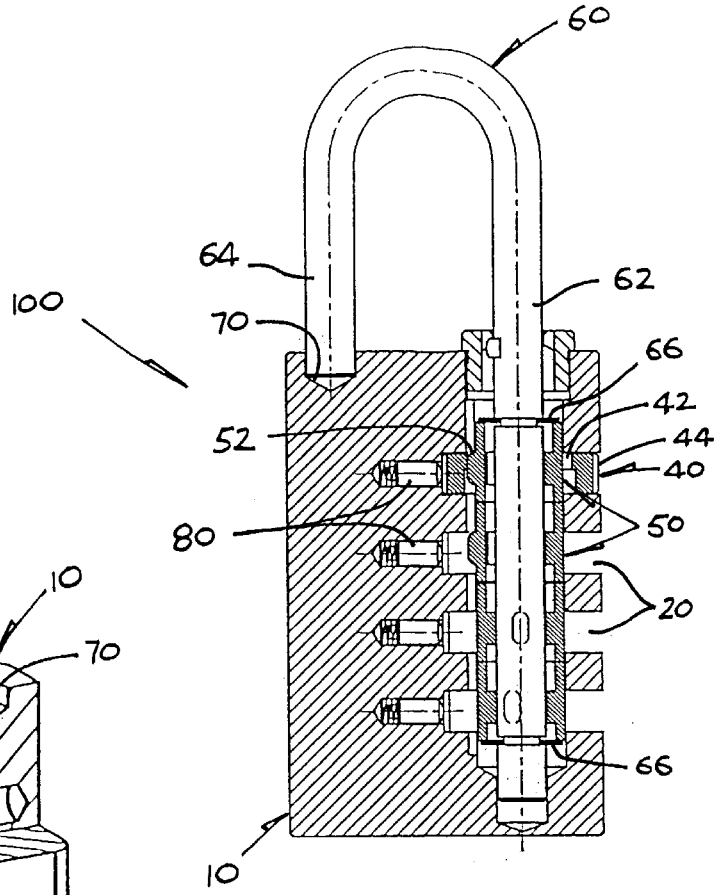
FIGS. 1A to 1C are cross-sectional side views of an embodiment of a combination lock in accordance with the invention, showing the lock in closed, open and code-changing conditions respectively.
Figure 3:
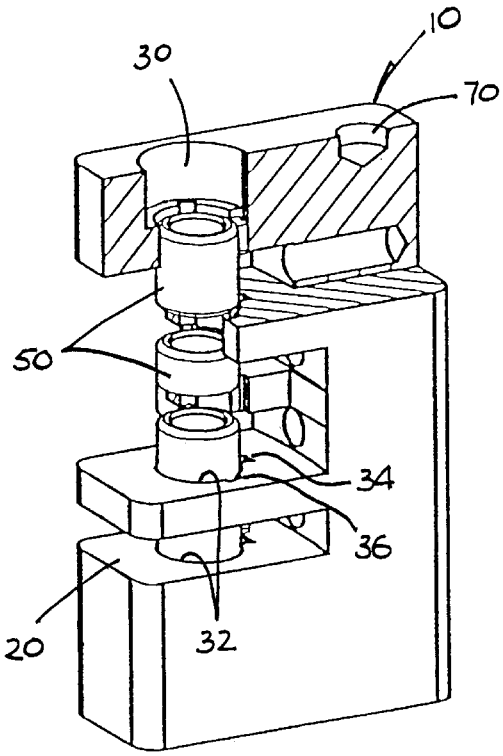
FIG. 3 is a perspective view of the lock of FIGS. 1A to 1C, with a shackle thereof omitted.
Figure 2:
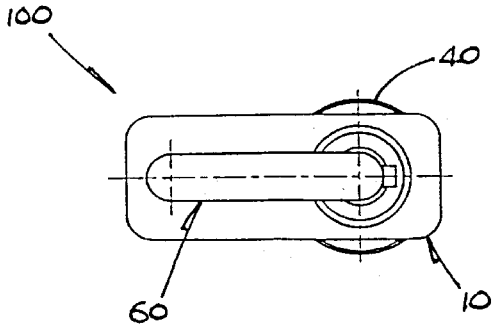
FIG. 2 is a top plan view of the lock of FIG. 1A.
Figure 1B:
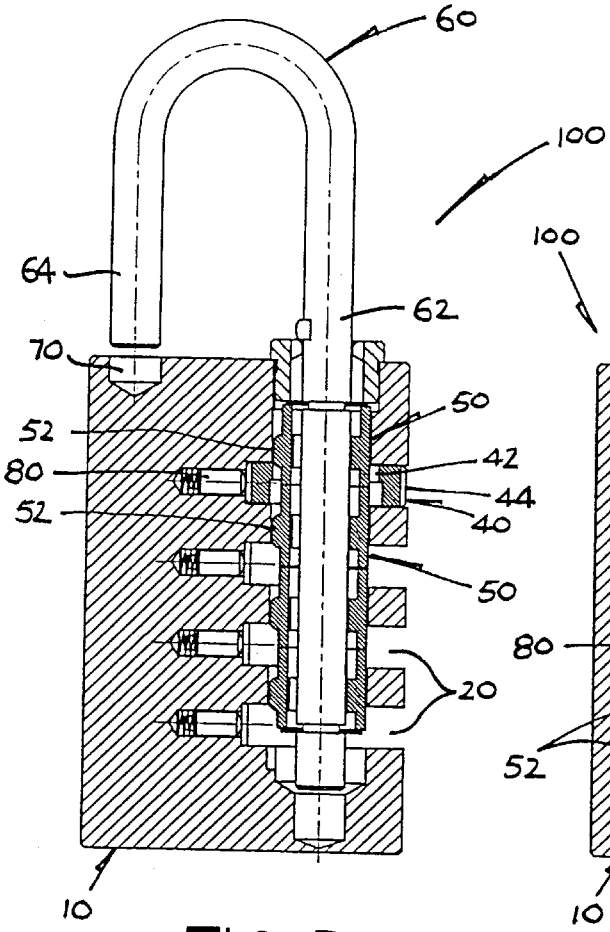

Referring to the drawings, there is shown a combination lock embodying the invention, which is in the form of a padlock 100 having an upright flat rectangular body 10. The body 10 is formed with a series of four parallel horizontal slots 20 laterally on one side and a vertical blind bore 30 extending downwards to intersect with the slots 20. The padlock 100 includes four dials 40 received in the respective slots 20 and an inverted J-shaped shackle 60 which has a longer limb 62 co-axially extending into the bore 30 and passing through the dials 40. The shackle limb 62 supports, co-axially thereon, a column of four tumbler sleeves 50 for individual rotation by the respective dials 40 surrounding them. A shorter limb 64 of the shackle 60 turns back for engagement with a locking recess 70 formed on the opposite lateral side of the body 10 (FIG. 1A).

The sleeves 50 are restrained on the shackle limb 62 by means of a pair of C-clips 66 at opposite ends, such that the sleeves 50 individually and the shackle limb 62 can only turn relative to each other. Each sleeve 50 is formed, integrally on its outer side, with a longitudinal locking fin 52. The fin 52 has a uniform thickness and a specific general radial dimension. A shallow right-angled step 54, having a depth in the range of 0.1 mm to 0.3 mm and preferably of about 0.2 mm, is formed at an uppermost end 56 of the fin 52 to provide an end radial dimension that is about half of the said general radial dimension.

Each dial 40 is formed with a ring of ten equi-angular recesses 42 around its upper inner side. The recesses 42 are provided for selectively accommodating the locking fin 52 of the corresponding sleeve 50, such that the sleeve 50 may be engaged with the dial 40, at any one of ten possible relative orientations (relevant to the setting of combination code), for individual rotation by the dial 40.

Figure 1C:
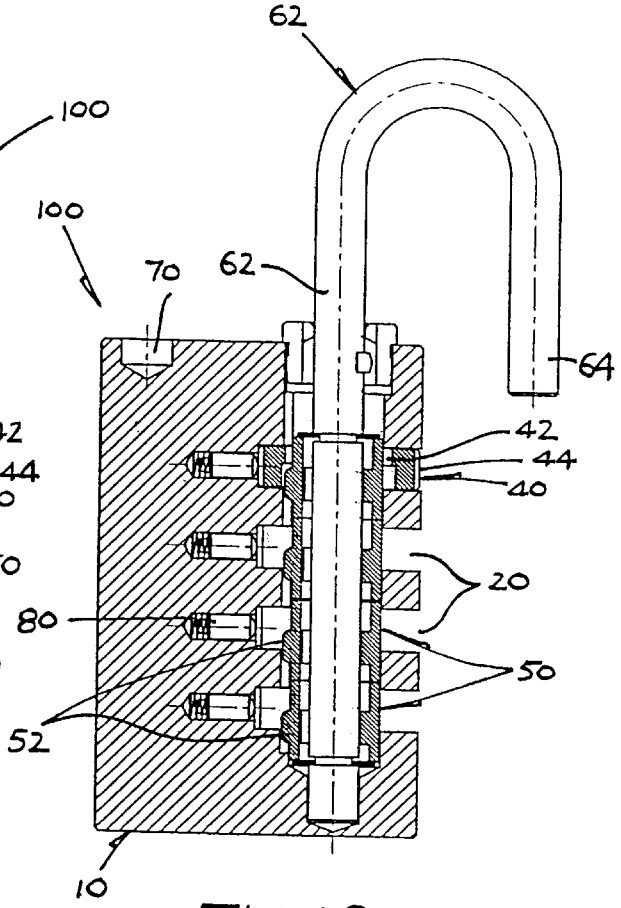

The lower inner side of the dial 40 is enlarged and made vacant to permit free rotation of the dial 40 relative to the respective sleeve 50 (with fin 52) when the sleeve 50 is being moved downwards by the shackle 60, while the shackle 60 is being pushed inwards in the fully swung open position, for changing the preset combination code (FIG. 1C).

The outer side of each dial 40 is formed with a ring of ten equi-angular teeth 44 marked with numerals "0" to "9" respectively. At the innermost end of each body slot 20, a spring-loaded pin 80 is provided for clicking engagement with the gaps between adjacent teeth 44 to define ten stable angular positions for the dial 40.

The bore 30, which intersects with the slots 20, forms five co-axial apertures 32 through the parts of the lock body 10 immediately above and below each slot 20. An unlocking groove 34 is formed on the inner side of each of the upper four apertures 32 (and also the lowermost aperture 32), which lies longitudinally on the central plane of the lock body 10. The unlocking groove 34 is accompanied by a pair of false-feel grooves 36 (also formed longitudinally on the inner side of the aperture 32) which are positioned at an angle of 72° apart from the unlocking groove 34 on opposite sides. The grooves 34 and 36 extend over the entire length of the apertures 32 in which they are formed, and are aligned with each other as between adjacent apertures 32.

Figure 4:
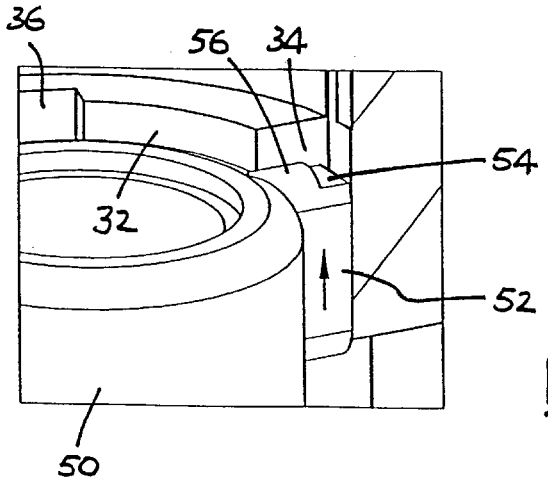
FIG. 4 is an enlarged perspective view of parts of the lock of FIG. 3, illustrating how the lock is opened.

Each unlocking groove 34 has a uniform cross-section (of depth H) which is slightly larger than the general cross-section of the locking fin 52 of the sleeve 50 immediately below the aperture 32 concerned, such that the sleeve 50 is movable upwards to enter into the aperture 32 when the sleeve 50 has been turned by the respective dial 40 to an unlocking position with the fin 52 aligned with the groove 34 (FIG. 4). Each false-feel groove 36 has a uniform cross-section (of depth ½H) which is about half of that of the unlocking groove 34 and is therefore only fit for the entrance of the uppermost end 56 of the fin 52.

Figure 6A:
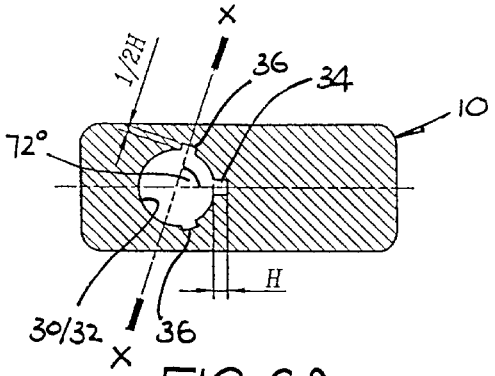
FIGS. 6A and 6B are cross-sectional top and side views corresponding to FIGS. 5A and 5B, showing how a false unlocking movement is effected.
Figure 6B:
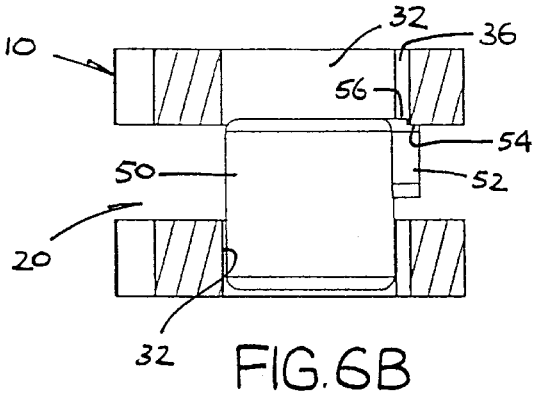
Figure 7A:
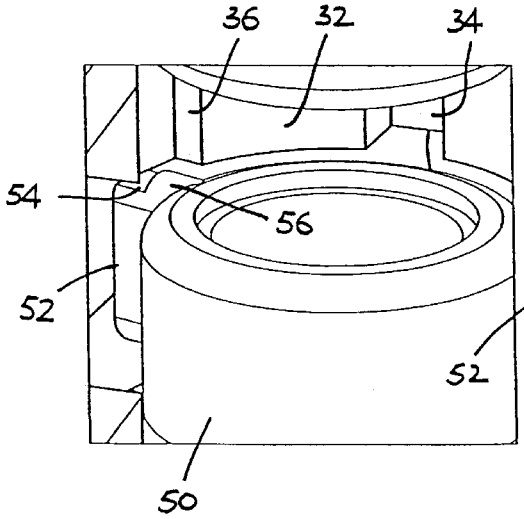
FIGS. 7A and 7B are enlarged perspective views of the lock parts of FIGS. 6A and 6B, illustrating the false unlocking movement in two steps.
Figure 7B:
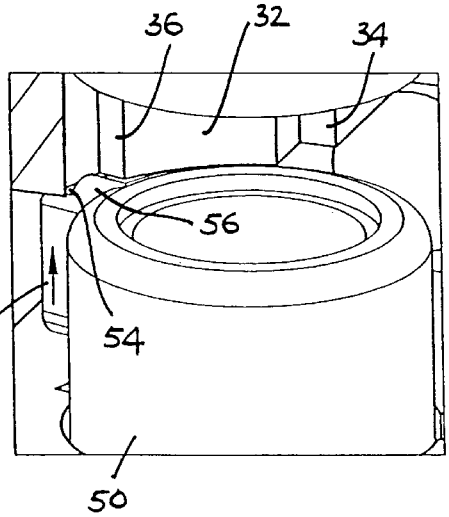

Upon turning to a position aligned with either false-feel groove 36 (line X—X of FIG. 6A; FIG. 7A), the sleeve 50 is movable upwards, but only to a limited extent (for about 0.2 mm), by reason of the uppermost end 56 of its locking fin 52 entering into the groove 36 and subsequently being blocked by the step 54 behind (FIGS. 6B and 7B). This slight movement gives a false impression that the sleeve 50 has been turned to the preset unlocking position, thereby confusing or misleading an unauthorised person picking the padlock 100 to think that this specific dial 40 has been overcome.

Figure 5A:
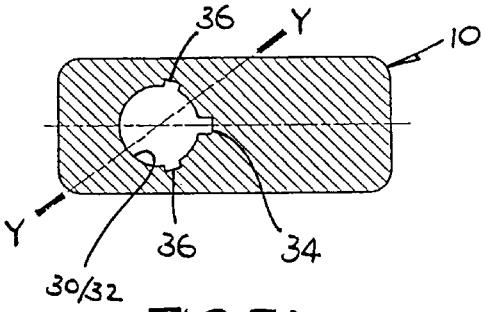
FIGS. 5A and 5B are cross-sectional top and side views of parts of the lock of FIG. 3, showing how the lock is closed.
Figure 5B:
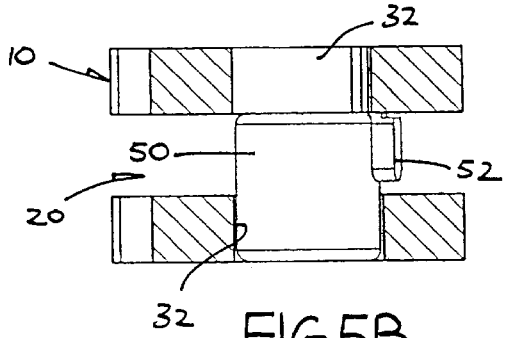

At any other angular position (line Y—Y of FIG. 5A), the sleeve 50 is not movable upwards by reason of its locking fin 52 being blocked by the bottom rim of the aperture 32 immediately above (FIG. 5B), where no groove 34 or 36 exists.

A datum line, or arrows, is usually marked on the lock body 10 for aligning the dials 40 corresponding to their stable angular positions (including the unlocking position preset for each as explained below). The false-feel grooves 36 are positioned at an angle of 72° from their associated unlocking grooves 34 such that the false-unlocking positions defined by them may also be aligned with the datum line, and this reinforces the false impression. It is understood that any other angle of integral multiple of 36°—equal to 360° divided by ten that being the number of stable dial positions—may be adopted to achieve the same effect.

It is envisaged that only one or more than two said false-feel grooves 36 may be formed in the apertures 32, depending on the production cost and the intended degree of protection against lock picking.

The cutting of the steps 54 externally on the locking fins 52 of the tumbler sleeves 50 and/or the false-feel grooves 36 longitudinally in the apertures 32 (where the unlocking grooves 34 are needed anyway) is relatively simple and may conveniently be carried out by automated machinery at relatively low cost and high speed. This allows the combination lock of the subject invention to be manufactured and marketed at a competitive price.

The construction of the padlock 100 and its operation will not be further described herein for clarity, because the rest is already generally known in the art, for example as disclosed in U.S. Pat. No. 5,715,709.

The invention has been given by way of example only, and various other modifications of and/or alterations to the described embodiment may be made by persons skilled in the art without departing from the scope of the invention as specified in the appended claims.

What is claimed is:

1. A combination lock, comprising:

a body formed with a plurality of parallel slots and a bore intersecting with the slots to form co-axial apertures through parts of the body immediately above and below each of the slots, each said aperture above a respective slot being formed with an unlocking groove;

a plurality of dials received in the slots respectively, each of which is formed around an inner side thereof with a ring of equi-angular recesses;

an inverted J-shaped shackle having a longer limb extending into the bore and passing through the dials; and a plurality of tumbler sleeves supported co-axially on the shackle longer limb for individual rotation, each of said tumbler sleeves having on an outer side thereof a locking fin engageable with one of the recesses of a respective dial for rotation by the dial to reach an unlocking position aligned with the unlocking groove of the aperture thereabove, such that the sleeve is movable into the aperture for unlocking the shackle, wherein the locking fin of at least one of the sleeves has an uppermost end which is formed with a step, and the aperture thereabove includes a false-feel groove apart from the unlocking groove for limited entrance by the uppermost end of the fin at a false-unlocking position, thereby giving a false impression that the respective sleeve has been rotated to the unlocking position.

2. The combination lock as claimed in claim 1, wherein the false-feel groove has a depth which is substantially half of that of the unlocking groove.

3. The combination lock as claimed in claim 1, wherein the step has a depth of substantially 0.1 mm to 0.3 mm.

4. The combination lock as claimed in claim 1, wherein the locking fin of each of the sleeves has an uppermost end which is formed with a said step, and the respective aperture above thereabove includes a said false-feel groove for co-operation with the uppermost end of the fin in the same manner.

5. The combination lock as claimed in claim 4, wherein the unlocking and false-feel grooves extend over the entire length of the apertures in which they are formed, and are aligned with each other as between adjacent apertures.

6. The combination lock as claimed in claim 1, wherein said at least one sleeve has a number of stable angular positions corresponding to the number of the recesses in the respective dial, which include the false-unlocking position.

7. The combination lock as claimed in claim 6, wherein the false-feel groove is positioned apart from the unlocking groove at an angle which is any integral multiple of 360° divided by the number of the stable angular positions for said at least one sleeve.

8. The combination lock as claimed in claim 7, wherein the false-feel groove is positioned apart from either side of the unlocking groove at an angle of 72°.

9. The combination lock as claimed in claim 1, being in the form of a padlock.

* * * * *